US011828530B2

(12) United States Patent
Brown et al.

(10) Patent No.: US 11,828,530 B2
(45) Date of Patent: Nov. 28, 2023

(54) SHELF ASSEMBLY

(71) Applicant: Electrolux Home Products, Inc., Charlotte, NC (US)

(72) Inventors: Cory Brown, Myrtle Beach, SC (US); Elki Spino, Atlanta, GA (US); Kwa'shun Jackson, Anderson, SC (US); Mitchell Madsen, Columbia, SC (US); Emmett Kornfeld, Simpsonville, SC (US); Nathanael Andersen, North Charleston, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 11 days.

(21) Appl. No.: 17/545,389

(22) Filed: Dec. 8, 2021

(65) Prior Publication Data

US 2023/0175766 A1 Jun. 8, 2023

(51) Int. Cl.
*F25D 25/02* (2006.01)

(52) U.S. Cl.
CPC ..... *F25D 25/02* (2013.01); *F25D 2325/021* (2013.01)

(58) Field of Classification Search
CPC ..... F25D 25/02; F25D 2325/021; F25D 2331/803; F25D 25/04; F25D 25/025; F25D 25/024; F25D 23/067; F25D 2331/809; F25D 25/027; F25D 25/021; F25D 2325/022; A47B 46/005; A47B 96/025; A47B 2210/175
See application file for complete search history.

(56) References Cited

U.S. PATENT DOCUMENTS 1,247,367 A * 11/1917 Burchell ..... A47B 17/04 312/266
3,331,645 A * 7/1967 Vercellotti ..... A47B 49/002 211/74
3,352,431 A 11/1967 Smith
4,528,825 A 7/1985 Khan
5,329,865 A * 7/1994 McWard ..... E05G 1/04 109/50
5,725,293 A * 3/1998 Wilkening ..... E04H 6/42 211/116
6,435,634 B1 * 8/2002 Webb ..... A47B 96/025 248/447
6,997,531 B2 * 2/2006 Kim ..... A47B 46/005 108/93

(Continued)

FOREIGN PATENT DOCUMENTS

CN 202254617 5/2012
CN 102506556 6/2012

(Continued)

*Primary Examiner* — Hiwot E Tefera
(74) *Attorney, Agent, or Firm* — Pearne & Gordon LLP

(57) ABSTRACT

A shelf assembly for a refrigerator includes a shelf; a base member defining a channel; a link member coupling the shelf to the base member such that the shelf is movable relative to the base member between a first position and a second position; a first pin pivotably coupling the link member to the base member; and a second pin pivotably coupling the link member to the shelf. The channel of the base member receives the second pin in the second position.

19 Claims, 7 Drawing Sheets

(56) References Cited

U.S. PATENT DOCUMENTS

| | | | | |
|---|---|---|---|---|
| 8,851,306 | B2 * | 10/2014 | Spurr | A47B 46/005 211/117 |
| 9,016,811 | B2 * | 4/2015 | Raunikar | A47B 88/473 312/249.7 |
| 10,408,530 | B1 | 9/2019 | Beck | |
| 10,408,531 | B1 | 9/2019 | Beck | |
| 10,415,874 | B1 | 9/2019 | Beck | |
| 11,060,789 | B2 * | 7/2021 | Beck | F25D 25/024 |
| 11,435,133 | B1 * | 9/2022 | Barik | A47B 96/025 |
| 2004/0195945 | A1 * | 10/2004 | Farber | A47B 57/04 312/408 |
| 2004/0207305 | A1 | 10/2004 | Kim et al. | |
| 2006/0097613 | A1 | 5/2006 | Lee et al. | |
| 2006/0125362 | A1 | 6/2006 | Kim | |
| 2006/0266905 | A1 | 11/2006 | Becke | |
| 2009/0058247 | A1 | 3/2009 | Collins et al. | |
| 2014/0252937 | A1 * | 9/2014 | Lee | F25D 25/02 312/404 |
| 2019/0339002 | A1 | 11/2019 | Beck | |
| 2020/0300038 | A1 * | 9/2020 | Pinnock | A47B 46/005 |

FOREIGN PATENT DOCUMENTS

| | | | | | |
|---|---|---|---|---|---|
| JP | 07035469 | A | * | 2/1995 | F25D 25/04 |
| KR | 2004039748 | A | * | 5/2004 | |
| WO | 9805910 | | | 2/1998 | |
| WO | 2011076833 | | | 6/2011 | |
| WO | 2013127070 | | | 9/2013 | |

* cited by examiner

SHELF ASSEMBLY

FIELD OF THE INVENTION

This application relates generally to a shelf assembly for a refrigerator appliance, and more particularly, to a shelf assembly that is movable between a first position and second position to be stored or deployed.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored, and the freezer compartment is where food items that are to be kept in a frozen condition are stored. Each compartment can include various storage structure for storing food items such as, for example, one or more shelves. However, a user may desire increased flexibility to organize and use the storage space by adjusting a vertical position of a shelf. For example, a user may desire to raise a position of the shelf to increase storage capacity below the shelf, or lower a position of the shelf to increase storage capacity above the shelf. Moreover, if the shelf is not needed, a user may desire to remove the shelf or keep the shelf within the compartment but reduce its consumption of space.

BRIEF SUMMARY OF THE INVENTION

In accordance with a first aspect, a shelf assembly for a refrigerator includes a shelf; a base member defining a channel; a link member coupling the shelf to the base member such that the shelf is movable relative to the base member between a first position and a second position; a first pin pivotably coupling the link member to the base member; and a second pin pivotably coupling the link member to the shelf. The channel of the base member receives the second pin in the second position.

In accordance with a second aspect, a shelf assembly for a refrigerator includes a shelf; a base member; and a link member coupling the shelf to the base member such that the shelf is swingable relative to the base member between a first position and a second position. The link member is pivotably coupled to the shelf and base member, and the base member is configured to inhibit swinging movement of the shelf from the second position to the first position by magnetic force.

In accordance with a third aspect, a shelf assembly for a refrigerator includes a shelf; a base member; and a link member pivotably coupled to the shelf and base member. The shelf is movable relative to base between a first position, a second position, and an intermediate position between the first position and second position, the shelf being swingable between the first position and intermediate position, and slidable between the intermediate position and second position. The base member is configured to inhibit sliding movement of the shelf from the second position to the intermediate position.

DESCRIPTION OF EXAMPLE EMBODIMENTS

Figure 1:
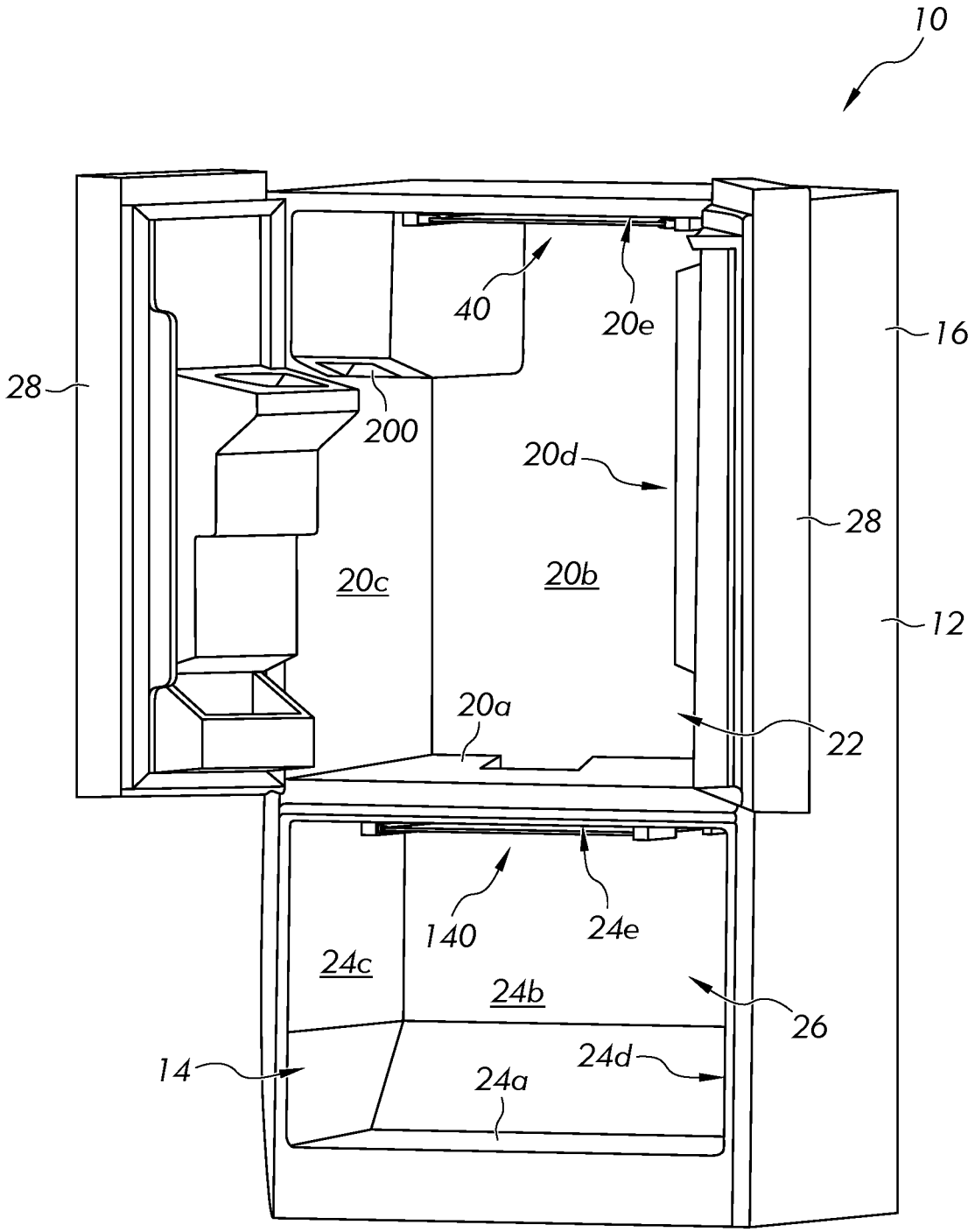
FIG. 1 is a front perspective view of an example refrigerator appliance.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

The term "substantially" as used herein is intended to note that the described features are equal or approximately equal to a value or characteristic, as desired, reflecting tolerances, conversion factors, rounding off, measurement error and the like, and other factors. For example, a "substantially parallel" configuration of two elements is intended to denote the two elements are parallel or approximately parallel to each other. Moreover, the term "substantially" can denote values that are within 10% of exact, for example within 5% of exact, or within 2% of exact. When the term "substantially" is used in describing a value or characteristic, the disclosure should be understood to include the exact value or characteristic being referred to.

Turning to FIG. 1, an example refrigerator 10 includes a cabinet 12 having an inner liner 14 and an outer shell 16 surrounding the inner liner 14. The liner 14 can comprise a plurality of walls that define one or more storage compartments for storing food items in a climate-controlled environment. For example, the liner 14 can comprises a first set of walls (i.e., bottom wall 20*a*, rear wall 20*b*, left side wall 20*c*, right side wall 20*d*, and top wall 20*e*) that define a first compartment 22, and a second set of walls (i.e., bottom wall 24*a*, rear wall 24*b*, left side wall 24*c*, right side wall 24*d*, and top wall 24*e*) that defines a second compartment 24. The first compartment 22 can be disposed vertically below the second compartment 26 or the first compartment 22 can be disposed vertically below the second compartment 26. In other examples, the first compartment 22 can be disposed laterally next to the second compartment 26.

The first compartment 22 can correspond to a fresh food compartment while the second compartment 26 corresponds to a freezer compartment, or vice versa. A configuration in which the freezer compartment is above the fresh food compartment can be referred to as a top mount configuration. However, the refrigerator 10 can have any desired configuration of one or more compartments, such as a bottom mount configuration (e.g., a freezer compartment disposed below a fresh food compartment), a side-by-side configuration (e.g., a fresh food compartment that is laterally next to a freezer compartment), or a standalone configuration (e.g., a standalone fresh food compartment or a standalone freezer compartment).

One or more doors can be pivotally coupled to the cabinet 12 to restrict and grant access to its compartment(s). For example, the refrigerator 10 can include a pair of French-type doors 28 that collectively span the entire lateral distance of the entrance to the first compartment 22 to enclose the first compartment 22, or a single door that spans the entire lateral distance across the entrance to the first compartment 22. One or more doors may be similarly provided to restrict and grant access to the second compartment 26.

Turning to FIGS. 2-5, a first example shelf assembly 40 will now be described that can be mounted within a compartment (e.g., first compartment 22 or second compartment 26) of the refrigerator 10. It is to be appreciated that any of the example shelf assemblies described herein can be utilized in any of the fresh food and/or freezer compartments. The shelf assembly 40 includes a shelf 42 and a plurality of hinge assemblies 44*a-d* for movably coupling the shelf 42 within the compartment such that the shelf 42 is adjustable between a lowered position (see FIG. 2) and a raised position (see FIG. 3).

The shelf 42 comprises a rigid panel 50 made of glass, plastic, or metal and having a substantially planar support surface 52 for supporting food items thereon. The support surface 52 is rectangular and defines a front edge 54*a*, a left edge 54*b*, a rear edge 54*c*, and a right edge 54*d* of the shelf 42. However, the panel 50 can comprise other materials and/or shapes in other examples. For instance, the panel 50 can be formed of injection-molded plastic or metal, and may be completely solid or include one or more holes therethrough to provide increased airflow. In one example, the holes can have a decorative shape such as a snowflake design, or any other desired shape. Moreover, the shelf 42 can further include one or more frame members that attach to and extend along one or more of the edges 54*a-d* of the panel 50. Generally speaking, the shelf 42 can comprise any configuration of one or more members that provides a substantially planar support surface for supporting food items thereon.

The shelf assembly 40 includes four hinge assemblies 44*a-d* that are provided near respective corners of the shelf 42. In particular, first and second hinge assemblies 44*a*, 44*b* are respectively provided near front and rear ends of shelf's left edge 54*b*, and third and fourth hinge assemblies 44*c*, 44*d* are respectively provided near front and rear ends of shelf's right edge 54*d*. However, the number and location of the hinge assemblies 44 can vary by embodiment, and the relative descriptions of sides (front, rear, left, right) are intended to provide clarity for the description and are not intended to be limiting upon the embodiments and/or claims.

The configuration of the first hinge assembly 44*a* will now be described in further detail. It is to be appreciated that the other hinge assemblies 44*b-d* are similarly configured, although the arrangement of certain features may be different in order to account for their different locations about the shelf 42.

Figure 4:
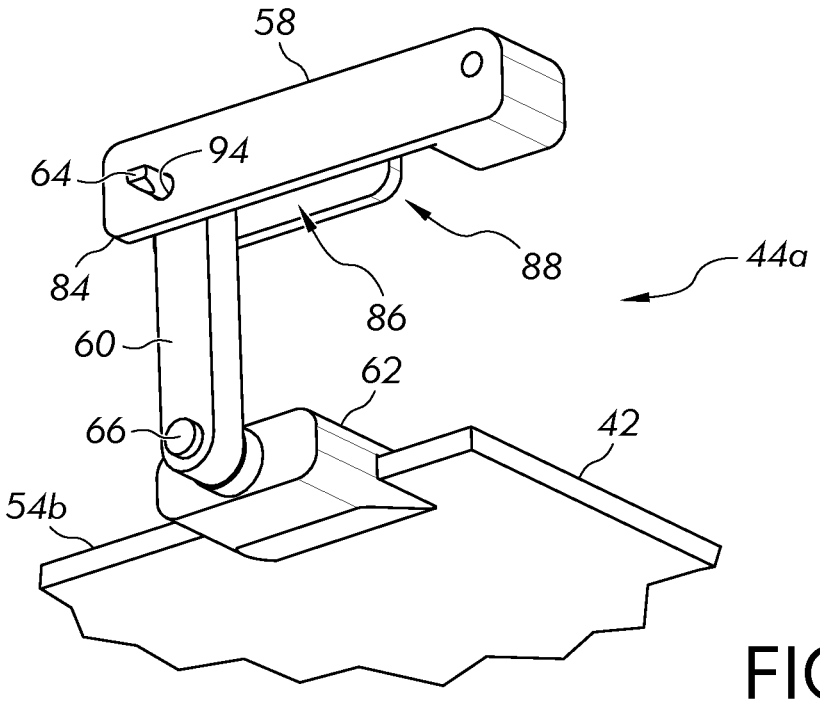
FIG. 4 is an enlarged view of the first shelf assembly with the shelf in the lowered position.
Figure 5:
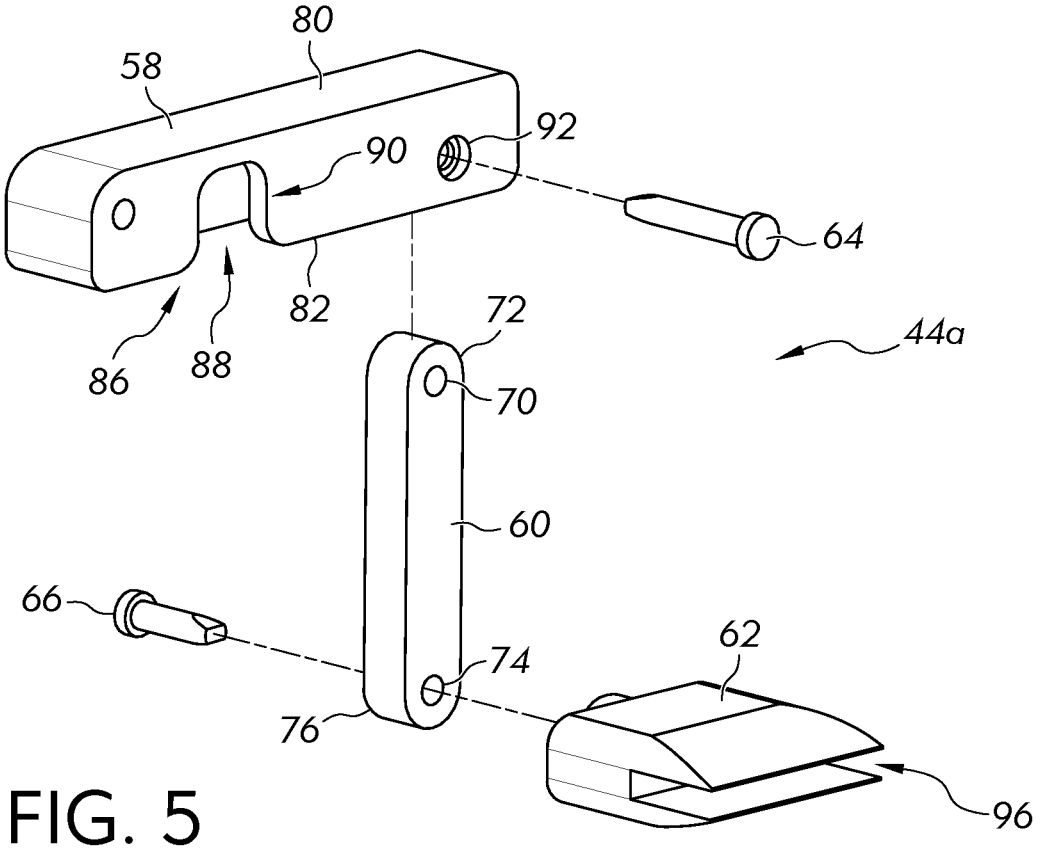
FIG. 5 is an exploded view of a hinge assembly for the first shelf assembly.

As shown in FIGS. 4 and 5, the hinge assembly 44*a* includes a base member 58, a link member 60, a holding member 62, and first and second pins 64, 66. The link member 60 is elongated body defining a first aperture 70 near a first end 72 of the link member 60, and a second aperture 74 near a second end 76 of the link member 60. Meanwhile, the base member 58 comprises an upper wall 80 and inner and outer side walls 82, 84 that extend downward from the upper wall 80. The base member 58 defines a channel 86 with a lower opening 88 and a side opening 90 that extends upward from an inner side of the lower opening 88. Moreover, the side walls 82, 84 of the base member 58 define respective apertures 92, 94.

The first end 72 of the link member 60 is pivotably coupled to the base member 58 by inserting it into the channel 86 and then inserting the first pin 64 through the apertures 70, 92, 94 of the link member 60 and base member 58. Meanwhile, the second end 76 of the link member 60 is pivotably coupled to the shelf 42 by coupling the holding member 62 to the shelf 42 and inserting the second pin 66 through the second aperture 74 of the link member 60 into a blind hole (not shown) of the holding member 62. Preferably, the pins 64, 66 include retention structure, such as snap clips, keyed geometry, friction fits, threaded geometry, etc. to resist removal from the apertures.

The holding member 62 defines a groove 96 that receives an edge 54 of the shelf 42 to couple the holding member 62 thereto. The shelf 42 can be removably or non-removably coupled to the holding member 62 in various manners, including a friction fit, adhesive, welding, or mechanical fasteners. Moreover, the second pin 66 is fixed relative to the holding member 62. However, the link member 60 can pivot about the second pin 66 and thus will be pivotable relative to the shelf 42 as coupled.

Figure 2:
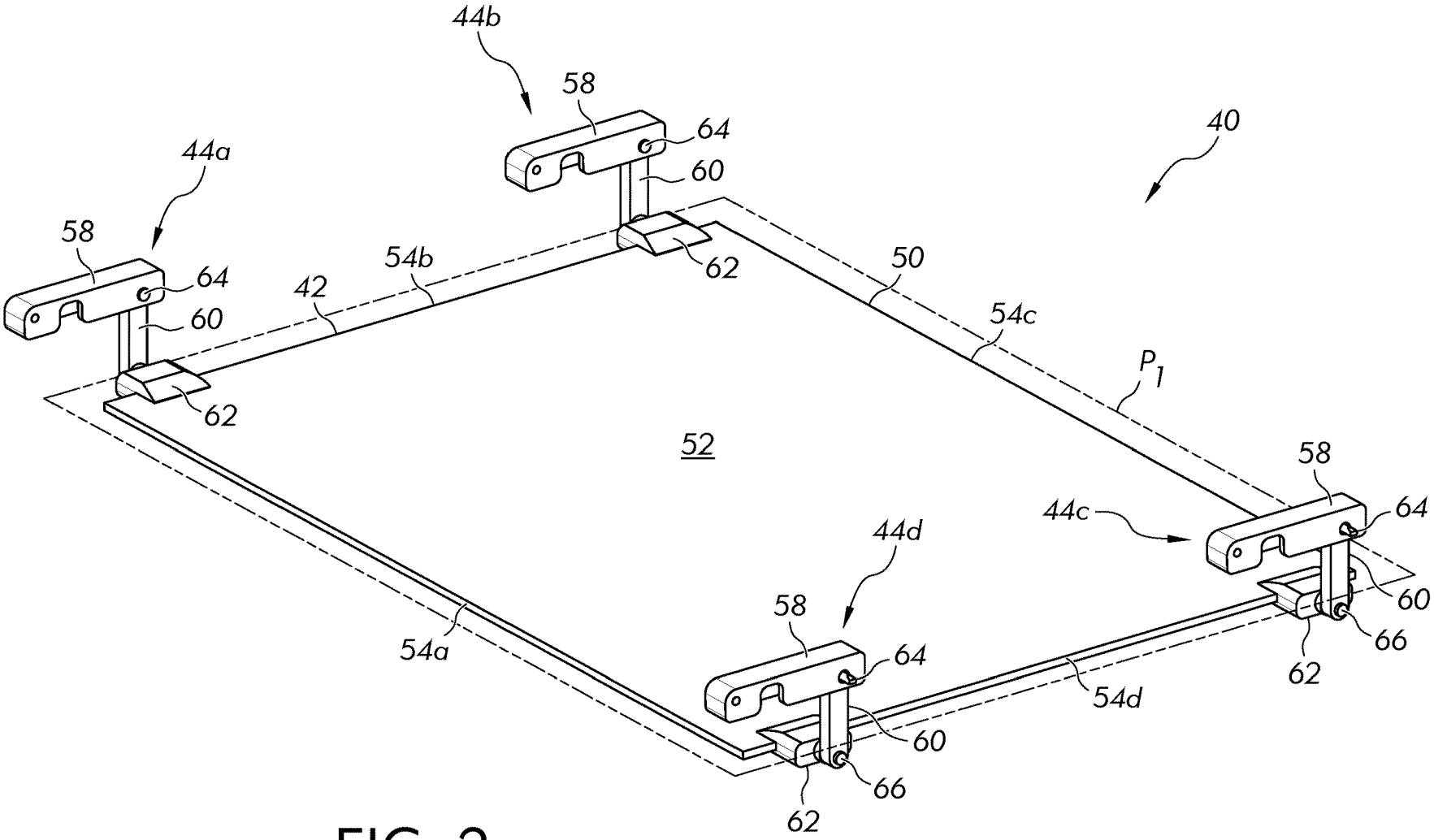
FIG. 2 is a perspective view of a first example shelf assembly for the refrigerator having a movable shelf, wherein the shelf is in a lowered position.
Figure 3:
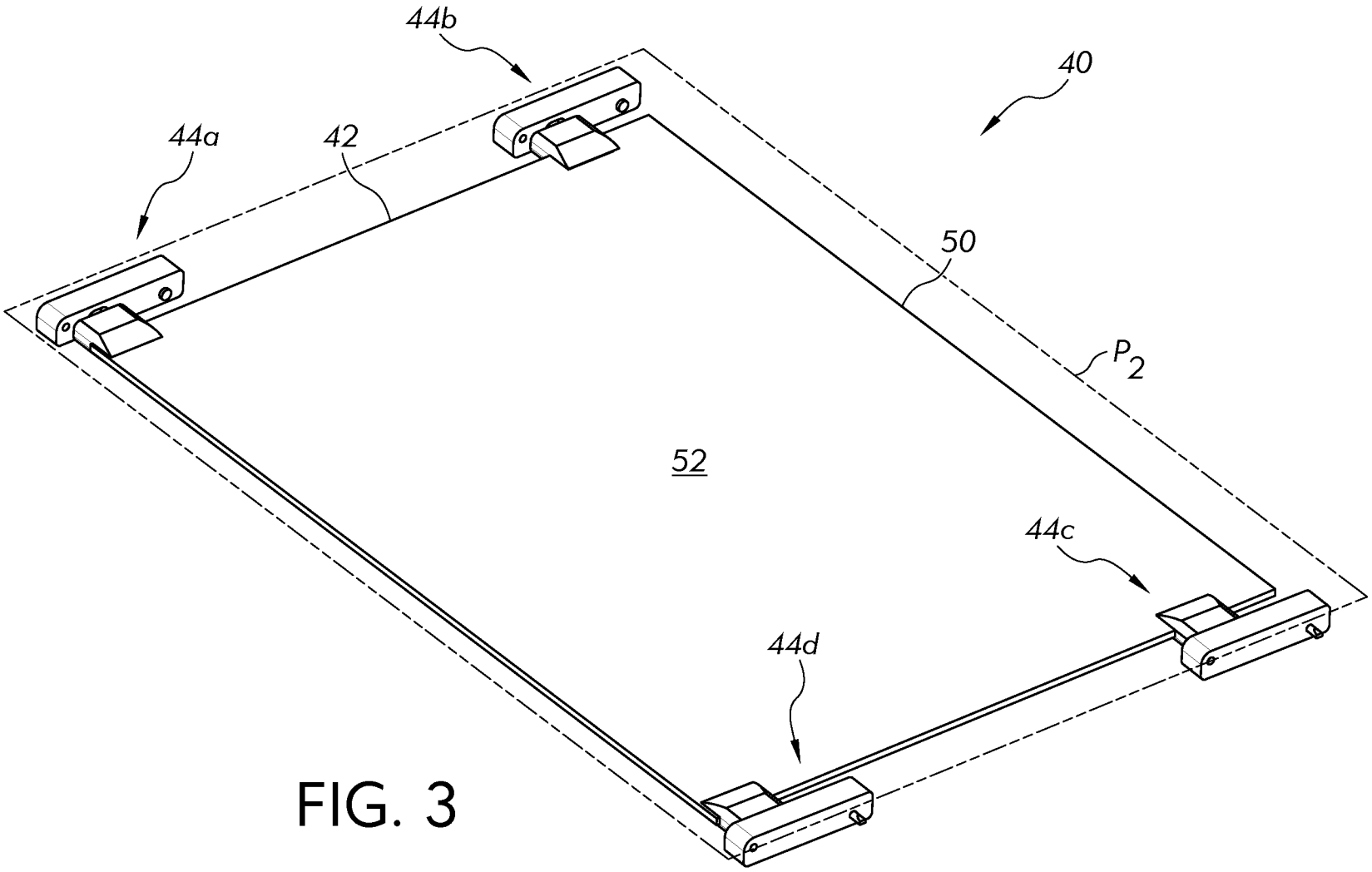
FIG. 3 is a perspective view of the first shelf assembly with the shelf is in a raised position.

When the shelf 42 is in its lowered position, the link member 60 will extend downward from the base member 58 (as shown in FIGS. 2 and 4). The shelf 42 can be moved from the lowered position to the raised position by swinging the shelf 42 forward and upward to the raised position. During this movement, the second end 76 of the link member 60 will pivot about the first pin 64 forward and upward until it enters the channel 86 of the base member 58 via the lower opening 88 (as shown in FIG. 3). The second pin 66 will similarly move with the second end 76 of the link member 60 into the channel 86, such that the pin 66 extends through the side opening 90 of the channel 86.

The shelf 42 can be moved from the raised position to the lowered position by swinging the shelf 42 downward and rearward in an opposite manner. During this movement, the second pin 66 and second end 76 of the link member 60 will pivot about the first pin 64 such that they leave the channel 86 of the base member 58 and eventually assume the position shown in FIGS. 2 and 4. The link member 60 will be substantially vertical in the lowered position, and substantially horizontal in the raised position. However, the link member 60 may have other orientations at these positions.

The other hinge assemblies 44*b-d* include the same features described above for the first hinge assembly 44*a*, although the arrangement of certain features may be different to account for their different locations about the shelf 42. For example, the side opening 90 of the first hinge assembly 44*a* is provided on the right side of its base member 58, whereas the side openings of the third and fourth hinge assemblies 44*c*, 44*d* are located on the left side of their base members 58. Nevertheless, the hinge assemblies 44*b-d* include all of the features described above for the first hinge assembly 44*a*, and will operate in the same way.

In this manner, the shelf 42 can be adjusted between its raised and lowered positions (see FIGS. 2-3, respectively) by swinging the shelf 42 relative to the base members 58 of each hinge assembly 44*a-d*. This movement is enabled by the pivotable connections of each link member 60 with the shelf 42 and its associated base member 58. When the shelf 42 is in the lowered position (see FIG. 2), its support surface 52 will extend along a first plane $P_1$ that is substantially horizontal. When the shelf 42 is in the raised position (see FIG. 3), its support surface 52 will extend along a second plane $P_2$ that is spaced above and substantially parallel to the first plane $P_1$. Moreover, the support surface 52 will remain substantially parallel to the first plane $P_1$ throughout its entire movement between the lowered and raised positions.

The shelf 42 in some examples may be slidable relative to the holding members 62 of the hinge assemblies 44*a-d* by sliding the shelf 42 through their grooves 96. In this manner, the forward/rearward location of the shelf 42 can be adjusted at its raised and/or lower positions. However, such sliding is optional and the shelf 42 may be fixed to the holding members 62 in some examples.

The shelf 42 is biased downward to the lowered position by gravity, and thus could fall from the raised position to the lowered position unless some mechanism is provided to hold the shelf 42 in place. Accordingly, the shelf assembly 40 can include one or more mechanisms to help retain the shelf 42 in the raised position and inhibit movement of the shelf 42 toward the lowered position. In one example, the base member 58 and second pin 66 of each hinge assembly 44*a-d* can be magnetic bodies that will magnetically couple to each other when the shelf 42 is in the raised position. As coupled, each base member 58 will generate a magnetic force that holds its associated second pin 66 in position, thus inhibiting swinging movement of the shelf 42 toward to the lowered position. To move the shelf 42 to the lowered position, a force can be applied to the shelf 42 that overcomes the combined magnetic force generated by the bae members 58. It is contemplated that "magnetic body" includes permanent magnets, electromagnets, and also materials having a high susceptibility to magnetization, such as ferromagnetic materials.

However, the shelf assembly 40 may have other configurations of magnetic bodies that can retain the shelf 42 in the raised position. For instance, a first magnetic body can be molded into the base member 58 of each hinge assembly 44*a-d* while a corresponding second magnetic body is fixed directly on the shelf 42. As another example, the link members 60 may be magnetic bodies that cooperate with the magnetic base members 58. The shelf assembly 40 can comprises any configuration of magnetic bodies that cooperate with each other to help retain the shelf 42 in its raised position by magnetic force.

In another example, one or more magnetic bodies could be attached to the support surface 52 which can magnetically engage with corresponding structure inside the cabinet of the refrigerator. In one embodiment, a magnetic body could be attached to the support surface 52 to magnetically engage with corresponding structure arranged at the ceiling of the refrigerator compartment to thereby hold the support surface 52 at the stored position against the force of gravity. In yet another example, the support surface 52 itself can comprise a magnetic body such as a ferromagnetic steel which could be retained against the ceiling of the compartment by one or more permanent magnets that are attached to or embedded within the ceiling.

Moreover, it is to be appreciated that the hinge assemblies 44*a-d* may comprise alternative configurations than those described above for enabling movement of the shelf 42 between its raised and lowered positions. For example, the holding members 62 of the hinge assemblies 44*a-d* can be integrally formed with the shelf 42 or omitted such that the second pins 66 are directly coupled to the shelf 42. As another example, two or more hinge assemblies 44*a-d* may have a common base member such that their link members 60 are pivotably coupled to the same base member. As yet another example, the pins 64, 66 of each hinge assembly 44 may be integrally formed with the link member 60 and pivotally connected to the base member 58 and shelf 42, or the pins 64, 66 can be pivotally connected to the link member 60 and integrally formed with the base member 58 and shelf 42.

Still further, the swinging directions by the hinge assemblies 44*a-d* may vary in other examples. For instance, the hinge assemblies 44*a-d* may be configured such that the shelf 42 swings rearward and upward from its lowered position to the raised position, instead of forward and upward. Broadly speaking, each hinge assemblies 44*a-d* can comprise any configuration of a base member and link member that enables the shelf 42 to move between raised and lowered positions by swinging the shelf 42 relative to the base member.

Turning to FIGS. 6-10, a second example shelf assembly 140 will now be described. In this embodiment, the shelf assembly 140 includes hinges assemblies 144*a-d* for movably coupling the shelf 42 such that it is adjustable between a lowered position (see FIG. 6), an initial-raised position (see FIG. 7), and a final-raised position (see FIG. 8), the initial-raised position being intermediate to the lowered position and final-raised position.

The shelf assembly 140 includes four hinge assemblies 144*a-d* that are provided near respective corners of the shelf 42. In particular, first and second hinge assemblies 144*a*, 144*b* are respectively provided near front and rear ends of shelf's left edge 54*b*, and third and fourth hinge assemblies 144*c*, 144*d* are respectively provided near front and rear ends of shelf's right edge 54*d*. However, the number and location of the hinge assemblies 144 can vary by embodiment, and the relative descriptions of sides (front, rear, left, right) are intended to provide clarity for the description and are not intended to be limiting upon the embodiments and/or claims.

The configuration of the first hinge assembly 144*a* will now be described in further detail. It is to be appreciated that the other hinge assemblies 144*b-d* are similarly configured, although the arrangement of certain features may be different in order to account for their different locations about the shelf 42.

Figure 9:
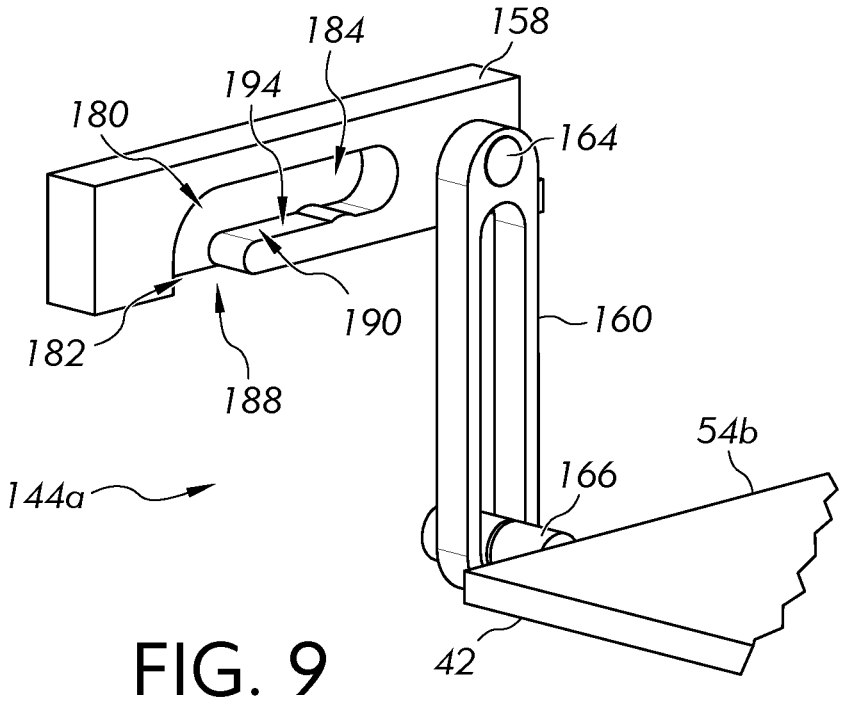
FIG. 9 is an enlarged view of the second shelf assembly with the shelf in the lowered position.
Figure 10:
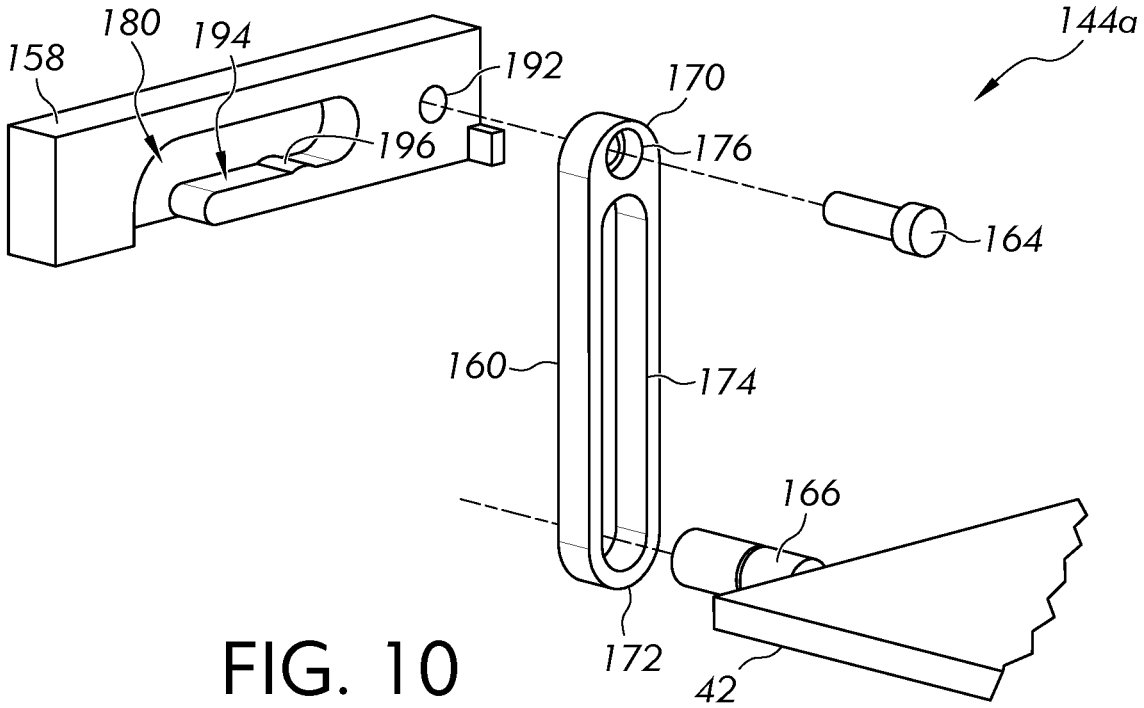
FIG. 10 is an exploded view of a hinge assembly for the second shelf assembly.

As shown in FIGS. 9 and 10, the hinge assembly 144*a* includes a base member 158, a link member 160, and first and second pins 164, 166. The link member 160 is an elongated body having first and second ends 170, 172 that defines an elongated slot 174 and aperture 176. Meanwhile, the base member 158 is a rectangular cuboid body that defines a channel 180 having a first linear portion 182, a second linear portion 184, a lower opening 188, and a side opening 190 that extends upward from an inner side of the lower opening 188. The first portion 182 of the channel 180 is substantially vertical and extends upward from the lower opening 188, while the second portion 184 is substantially horizontal and extends rearward from an upper end of the first portion 182. Moreover, the base member 158 defines an aperture 192 and a support surface 194 with a raised ridge portion 196.

The first end 170 of the link member 160 is pivotably coupled to the base member 158 by inserting the first pin 164 through the apertures 176, 192 of the link member 160 and base member 158. Meanwhile, the second pin 166 is integrally formed with the shelf 42 and inserted through the slot 174 of the link member 160 to pivotably and slidably couple the link member 160 to the shelf 42. As with the other embodiments described herein, the pins 164, 166 preferably include retention structure, such as snap clips, keyed geometry, friction fits, threaded geometry, etc. to resist removal from the apertures.

Figure 6:
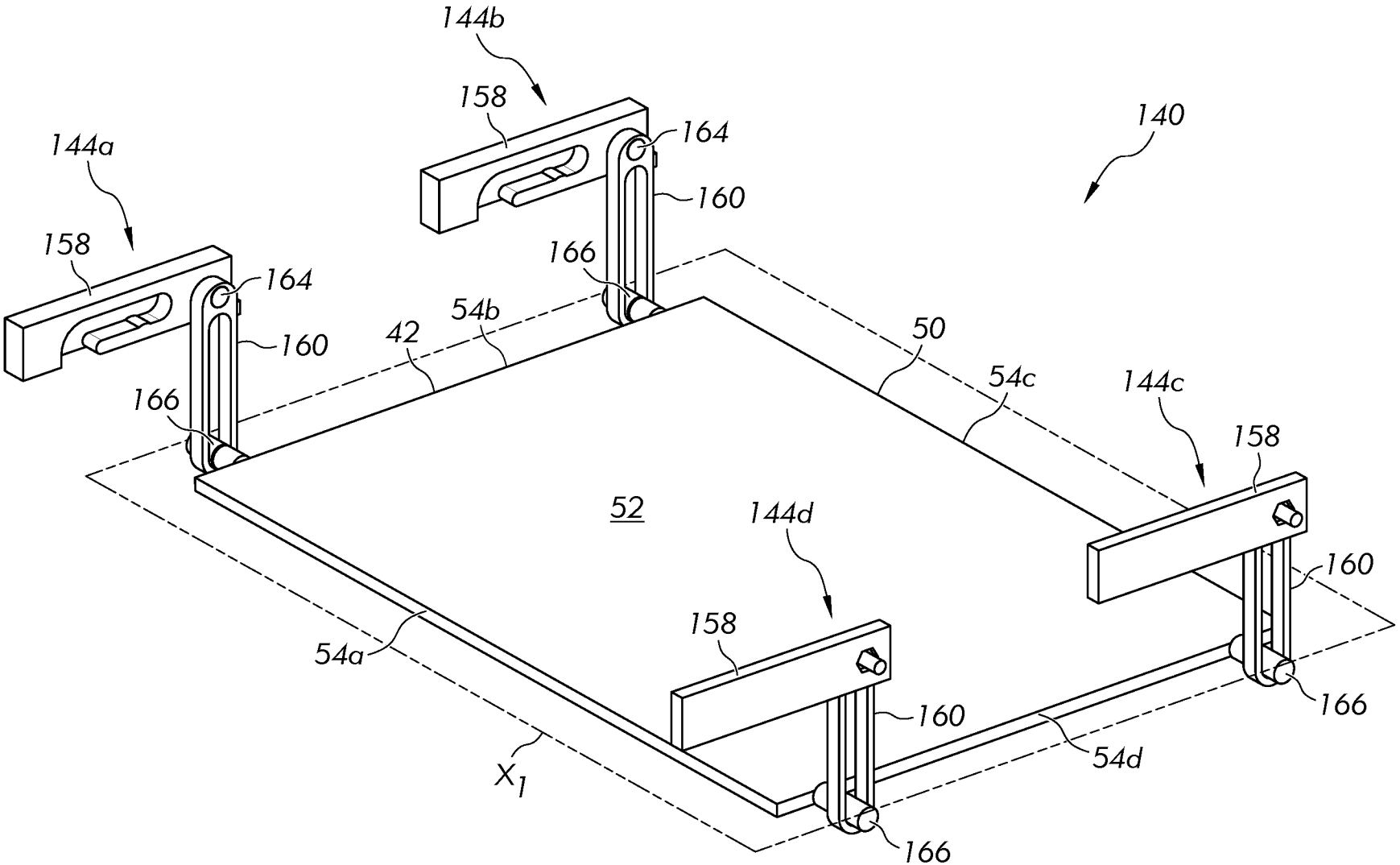
FIG. 6 is a perspective view of a second example shelf assembly for the refrigerator having a movable shelf, wherein the shelf is in a lowered position.
Figure 7:
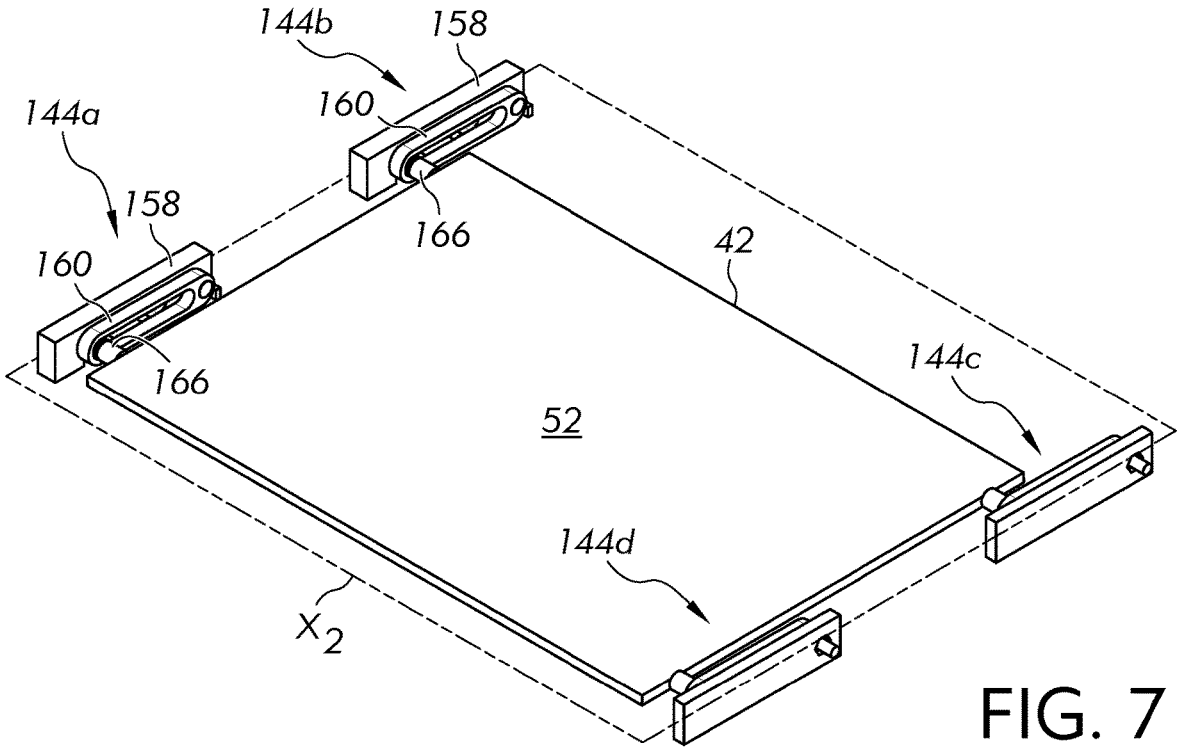
FIG. 7 is a perspective view of the second shelf assembly with the shelf is in an initial-raised position.
Figure 8:
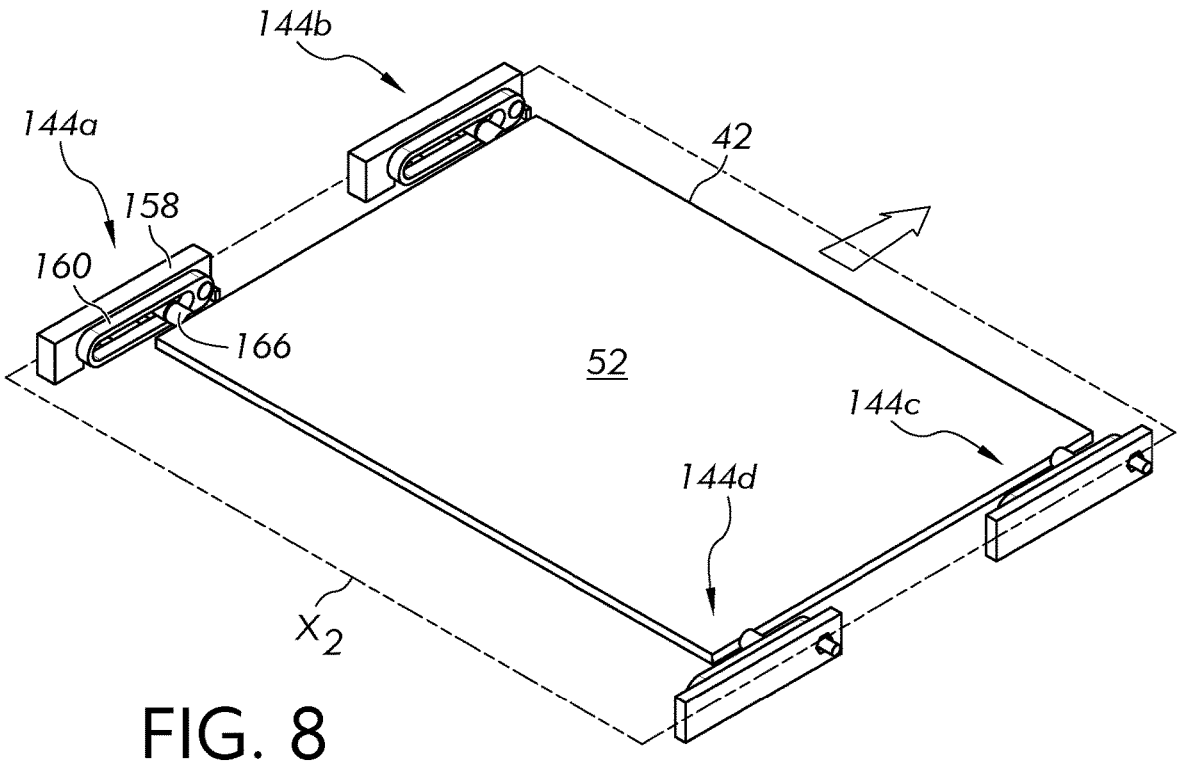
FIG. 8 is a perspective view of the second shelf assembly with the shelf is in a final-raised position.

When the shelf 42 is in its lowered position, the link member 160 will extend downward from the base member 158 (as shown in FIGS. 6 and 9). The shelf 42 can be moved from the lowered position to the initial-raised position by swinging the shelf 42 forward and upward. During this movement, the second pin 166 and second end 172 of the link member 160 will pivot about the first pin 164 until the second pin 166 enters the first portion 182 of the channel 180 via its lower opening 188.

From the initial-raised position, the shelf 42 can be slid rearward relative to the base member 158 until it reaches the final-raised position. During this movement, the link member 160 will remain mostly stationary while the second pin 166 rests on and slides along the support surface 194 of the base member 158, sliding through the slot 174 of the link member 160 and the second portion 184 of the channel 180. However, the second pin 166, shelf 42, and link member 160 will briefly rise as the second pin 166 surpasses the raised ridge portion 196 of the support surface 194.

The other hinge assemblies 144*b-d* include the same features described above for the first hinge assembly 144*a*, although the arrangement of certain features may be different to account for their different locations about the shelf 42. For example, the side opening 190 of the first hinge assembly 144*a* is provided on the right side of its base member 158, whereas the side openings of the third and fourth hinge assemblies 144*c*, 144*d* are located on the left side of their base members 158. Nevertheless, the hinge assemblies 144*b-d* include all of the features described above for the first hinge assembly 144*a*, and will operate in the same way.

In this manner, the shelf 42 in the second shelf assembly 140 can be adjusted between its raised and lowered positions by swinging and sliding the shelf 42 relative to the base members 158 of each hinge assembly 144*a-d*. In contrast, the shelf 42 in the first shelf assembly 40 is not slidable relative to its base members 58 but rather is simply swingable between its raised and lowered positions.

The swinging and sliding movement of the shelf 42 in the second shelf assembly 140 is enabled by the pivotable connections of each link member 160 with the shelf 42 and its associated base member 158, as well as the sliding connection of each link member 160 with the shelf 42. When the shelf 42 is in the lowered position (see FIG. 6), its support surface 52 will extend along a first plane $X_1$ that is substantially horizontal. When the shelf 42 is in the initial- and final-raised positions (see FIGS. 7 and 8), its support surface 52 will extend along a second plane $X_2$ that is spaced above and substantially parallel to the first plane $X_1$. Moreover, the support surface 52 will remain substantially parallel to the first plane $X_1$ throughout its entire movement between the lowered and raised positions.

The shelf 42 is biased downward by gravity, and thus will fall from the initial-raised position to the lowered position unless supported by an external force. However, when the shelf 42 is in its final-raised position, the second pins 166 of the hinge assemblies 144*a-d* will rest on the support surfaces 194 of their respective base members 158, thus keeping the shelf 42 in its raised state. Moreover, the raised ridge portion 196 of each support surface 194 can inhibit the shelf 42 from sliding forward to the initial-raised position, since the shelf 42 and second pins 166 must rise against gravity to surpass each raised ridge portion 196 and slide forward. In one example, the raised ridge portion 196 can decrease the width of the channel 180 to be less than the diameter of the second pin 166 so that the raised ridge portion 196 provides a click-lock feature to retain the shelf at the raised position.

It is to be appreciated that the hinge assemblies 144*a-d* may comprise alternative configurations than those described above for enabling movement of the shelf 42 between its raised and lowered positions. For example, the pins 164, 166 of each assembly 144*a-d* may be integrally formed with the link member 160 and pivotably coupled to the base member 158 and shelf 42, with one or both of the pins 164, 166 being slidable relative to the base member 158 and/or shelf 42. As another example, the first and second portions 182, 184 of each channel 180 may be non-linear and/or extend at other angles besides vertical and horizontal.

Still further, the swinging and sliding directions enabled by the hinge assemblies 144*a-d* may vary in other examples. For instance, the hinge assemblies 144*a-d* may be configured such that the shelf 42 swings rearward and upward from its lowered position to the initial-raised position, and then slides forward from the initial-raised position to the final-raised position. Broadly speaking, each hinge assemblies 144*a-d* can comprise any configuration of a base member and link member that enables the shelf 42 to move between raised and lowered positions by swinging and sliding the shelf 42 relative to the base member.

The shelf assemblies 40, 140 described above can be mounted within a compartment (e.g., first compartment 22 or second compartment 26) of the refrigerator 10 by fixing their base members 58, 158 to the inner liner 14, either directly or indirectly via some other structure fixed to the liner 14. For example, as shown in FIG. 1, the first shelf assembly 40 can be installed within the first compartment 22 such that it is located near the top wall 20*e* between an ice maker 200 and the right wall 20*d*. The base members 58 of its left-side hinge assemblies 44*a*, 44*b* can be fixed to the ice maker 200 while the base members 58 of its right-side hinge assemblies 44*c*, 44*d* can be fixed to the right wall 20*d*. Meanwhile, the second shelf assembly 140 can be installed within the second compartment 26 such that the base members 58 of its hinge assemblies 144*a-d* are attached to and depend from the top wall 24*e*.

FIG. 1 shows the first and second shelf assemblies 40, 140 in their raised positions. The base members 58, 158 of the shelf assemblies 40, 140 can be fixed to a supporting cabinet wall using, for example, fasteners, adhesive, and/or welding. Alternatively, the base members 58, 158 of the shelf assemblies 40, 140 can be fixed to their respective structures by forming them integrally therewith. In one example, the base members 58, 158 could even be molded directly into the cabinet liner.

Moreover, the shelf assemblies 40, 140 can be mounted adjacent to the top walls 20*e*, 24*e* such that their shelves 42 will be substantially flush with and parallel to the top walls 20*e*, 24*e* in the raised position. For example, the first shelf assembly 40 can be mounted within the first compartment 22 such a distance between the top wall 20*e* and the shelf 42 in its raised position is preferably less than or equal to 2 inches, more preferably less than or equal to 1 inch, and still more preferably less than or equal to 0.5 inches. Optionally, a portion of top wall 20*e* can also be recessed so that, in the retracted position, the shelf 42 sits flush with the cabinet ceiling to thereby provide a compartment for storing food that is obscured or even hidden from view. Meanwhile, a distance between the top wall 20*e* and the shelf 42 in its lowered position is preferably greater than or equal to 3 inches, and more preferably greater than or equal to 4 inches. The second shelf assembly 140 can be mounted within the second compartment 26 such that the same distances are achieved relative to the top wall 24*e*. In this manner, the shelf 42 of each assembly 40, 140 can be moved to its lowered position as desired to provide a surface for storing food items thereon, or moved to its raised position as desired to occupy little space and provide more available storage capacity within the compartment below the shelf 42.

It is to be appreciated that the first and second shelf assemblies 40, 140 can be installed opposite to the configuration illustrated in FIG. 1, such that the first shelf assembly 40 is installed within the second compartment 26 and the second shelf assembly 140 is installed in the first compartment 22. Similar distances between the top walls 20*e*, 24*e* of the compartments 22, 26 and the shelves 42 of the assemblies 40, 140 can be achieved in such embodiments. Still further, only one of the shelf assemblies 40, 140 may be provided in some examples, or both shelf assemblies 40, 140 may be installed within the same compartment. Broadly speaking, the refrigerator 10 can comprise any configuration in which one or both of the shelf assemblies 40, 140 are installed within the same or different compartments.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A shelf assembly for a refrigerator, comprising:

a shelf;

a base member defining a channel;

a link member coupling the shelf to the base member such that the shelf is movable relative to the base member between a first position and a second position;

a first pin pivotably coupling the link member to the base member; and a second pin pivotably coupling the link member to the shelf, wherein the channel of the base member accommodates the second pin in the second position, wherein the base member defines a lower opening and a side opening of the channel, the side opening extending upward from the lower opening, wherein the second pin extends through the side opening of the channel when the shelf is in the second position.

2. The shelf assembly according to claim 1, wherein the shelf is swingable relative to the base member.

3. The shelf assembly according to claim 1, wherein the shelf comprises a support surface that extends along a first plane in the first position and a second plane in the second position, the first plane and second plane being spaced from and substantially parallel to the other.

4. The shelf assembly according to claim 1, wherein the first position and second position respectively correspond to a lowered position and a raised position.

5. The shelf assembly according to claim 1, further comprising a holding member that couples the shelf to the second pin, the holding member defining a groove that accommodates an edge of the shelf, wherein the shelf is slidable within the groove relative to the holding member.

6. The shelf assembly according to claim 1, wherein the base member is configured to inhibit movement of the shelf from the second position to the first position.

7. The shelf assembly according to claim 6, wherein the base member comprises a support surface that supports the shelf in the second position, the support surface having a raised ridge portion that inhibits movement of the shelf from the second position to the first position.

8. The shelf assembly according to claim 7, wherein the base member is configured to inhibit movement of the shelf from the second position to the first position by magnetic force.

9. The shelf assembly according to claim 1, wherein the shelf is movable to an intermediate position between the first position and second position, the shelf being swingable between the first position and intermediate position, and slidable between the intermediate position and second position.

10. The shelf assembly according to claim 1, wherein:

the base member is configured to inhibit swinging movement of the shelf from the second position to the first position by magnetic force, the base member comprises a first magnetic body, and the link member or second pin comprises a second magnetic body that magnetically couples to the first magnetic body when the shelf is in the second position.

11. The shelf assembly according to claim 10, wherein the shelf is not slidable relative to the base member.

12. The shelf assembly according to claim 10, wherein the shelf comprises a support surface that extends along a first plane in the first position and a second plane in the second position, the first plane and second plane being spaced from and substantially parallel to the other.

13. The shelf assembly according to claim 1, wherein:

the shelf is movable relative to base between the first position, the second position, and an intermediate position between the first position and second position, the shelf being swingable between the first position and intermediate position, and slidable between the intermediate position and second position, the base member is configured to inhibit sliding movement of the shelf from the second position to the intermediate position, and the base member comprises a support surface that supports the shelf in the second position, the support surface having a raised ridge portion that inhibits sliding movement of the shelf from the second position to the intermediate position.

14. The shelf assembly according to claim 13, wherein the shelf comprises a support surface that extends along a first plane in the first position and a second plane in the intermediate position and second position, the first plane and second plane being spaced from and substantially parallel to the other.

15. The shelf assembly according to claim 13, wherein the channel has a first portion that accommodates the second pin when the shelf is in the intermediate position, and a second portion that accommodates the second pin when the shelf is in the second position.

16. The shelf assembly according to claim 15, wherein the link member defines an elongated slot that the pin extends through such that the second pin is slidable along the slot.

17. The shelf assembly according to claim 13, wherein the second pin rests on the support surface of the base member when the shelf is in the second position.

18. A refrigerator comprising:

a cabinet liner that defines a compartment; and the shelf assembly according to claim 1, wherein the base member is fixed to or integrally formed together with the cabinet liner.

19. The refrigerator according to claim 18, wherein:

the cabinet liner comprises a top wall, a bottom wall, a rear wall, and a pair of side walls that collectively define the compartment, and a distance between the top wall and the shelf in the second position is less than or equal to 2 inches.

* * * * *